United States Patent [19]

Braid

[11] 3,984,337

[45] Oct. 5, 1976

[54] LUBRICANT COMPOSITIONS CONTAINING NAPHTHYLAMINO BENZAMIDE ANTIOXIDANTS

[75] Inventor: Milton Braid, Westmont, N.J.

[73] Assignee: Mobil Oil Corporation, New York, N.Y.

[22] Filed: May 21, 1975

[21] Appl. No.: 579,540

Related U.S. Application Data

[60] Division of Ser. No. 375,391, July 2, 1973, abandoned, which is a continuation-in-part of Ser. No. 127,014, March 22, 1971, abandoned.

[52] U.S. Cl. ..... 252/51.5 A; 252/401

[51] Int. Cl.[2] ..... C10M 1/32

[58] Field of Search ..... 252/51.5 A, 403

[56] References Cited

UNITED STATES PATENTS

| | | | |
|---|---|---|---|
| 2,369,090 | 2/1945 | Trautman | 252/51.5 A X |
| 2,390,943 | 12/1945 | Kavanagh et al. | 252/51.5 A X |
| 2,959,550 | 11/1960 | Young et al. | 252/51.5 A X |
| 3,224,969 | 12/1965 | Hotten | 252/51.5 A X |
| 3,282,840 | 11/1966 | Foster et al. | 252/51.5 A X |
| 3,585,137 | 6/1971 | Bosniack et al. | 252/51.5 A X |
| 3,642,632 | 2/1972 | Coburn et al. | 252/51.5 A |
| 3,767,575 | 10/1973 | Braid | 252/51.5 A X |
| 3,856,690 | 12/1974 | Braid | 252/51.5 A |

*Primary Examiner*—Delbert E. Gantz
*Assistant Examiner*—Andrew H. Metz
*Attorney, Agent, or Firm*—Charles A. Huggett; Raymond W. Barclay; Stanley A. Strober

[57] ABSTRACT

The oxidative properties of lubricants, especially lubricating oils and greases, are improved by adding thereto an oxidation inhibiting amount of a diarylamine ortho-carboxamide.

4 Claims, No Drawings

LUBRICANT COMPOSITIONS CONTAINING NAPHTHYLAMINO BENZAMIDE ANTIOXIDANTS

CROSS-REFERENCE TO RELATED APPLICATIONS

This is a division of copending application Ser. No. 375,391, filed July 2, 1973 which was a continuation-in-part of application Ser. No. 127,014 filed Mar. 22, 1971, now abandoned. Said Ser. No. 375,391, now abandoned.

BACKGROUND OF THE INVENTION

1. Field of the Invention

This invention relates to novel compositions of matter useful in the preparation of lubricant compositions. In particular, the invention relates to lubricants to which have been added sufficient amounts of an additive which will impart antioxidant properties thereto.

2. Discussion of the Prior Art

Lubricating oils and greases are subject to oxidative deterioration at elevated temperatures or upon prolonged exposure to the elements. The deterioration is evidenced, in many instances, by an increase in acidity and in viscosity, and, when such deterioration is severe enough, it can cause metal parts to corrode. Additionally severe oxidation leads to a loss of lubricating properties of the oil, and, in aggravated cases, to complete breakdown of the lubricated part or of the entire machine. In combatting oxidation, many additives have been tried, but many of them are only marginally effective except at high concentrations, especially when the lubricants are subjected to drastic oxidizing conditions.

The compositions of this invention are novel. U.S. Pat. No. 3,585,137 discloses, as a metal passivator in ester lubricants, an anthranilamide compound. However, anthranilamide and the other "useful compounds" set forth in columns 4 and 5 of this patent are not the same as the present compounds.

SUMMARY OF THE INVENTION

The invention provides a lubricant composition comprising a major amount of a lubricant and an amount sufficient to improve the oxidative properties thereof of a diarylamine ortho-carboxamide.

DESCRIPTION OF SPECIFIC EMBODIMENTS

The diarylamine ortho-carboxamides useful in the practice of the present invention are those corresponding to the formula

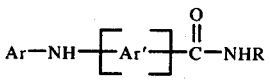

wherein Ar is selected from the group consisting of phenyl, naphthyl, alkylphenyl, alkoxyphenyl, alkylnaphthyl and alkoxynaphthyl, the alkyl and alkoxy portions having 1 to about 20 carbon atoms, Ar′ is selected from the divalent members of Ar, and R is selected from the group consisting of hydrogen, alkyl of from 1 to about 20 carbon atoms, the

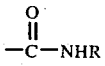

group being attached in the position ortho to the N-attachment of the amino group. It will be understood that "divalent members of Ar" shall mean phenylene, naphthylene, alkylphenylene, alkylnaphthylene, alkoxyphenylene and alkoxynaphthylene.

Compounds that come within the above generic disclosure and that may be used in the practice of the present invention include the following:

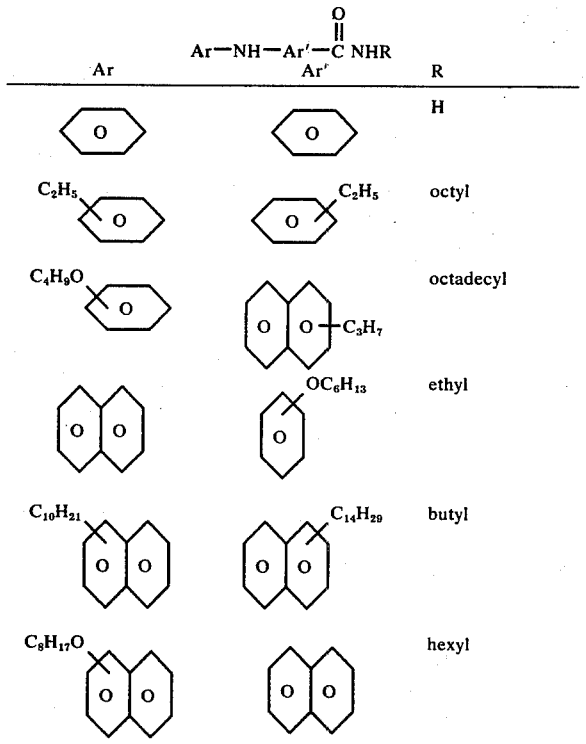

The diarylamine carboxamides may be prepared in known ways. For example, they may be prepared from the corresponding acid halide by reaction with the appropriate amine, by aminolysis of N-arylanthranilic acid esters and by reaction of N-arylisatoic anhydrides with amines.

In general, the reactions are allowed to proceed in an inert organic solvent. For instance, the acid chlorides of the diarylamine carboxylic acids are reacted with the appropriate amine in a solvent such as petroleum ether, cyclohexane, benzene, toluene, xylene and the like. In the reaction, an excess of amine may be used as a hydrogen halide acceptor, or other agents, such as unreactive tertiary amines (e.g., triethylamine or pyridine) may be present for this purpose. Reaction temperatures of from about 0°C. to about 150°C. may be used, but temperatures in the range of from about 0°C. to about 20°C. are preferred for the initial mixing of reactants. Reaction times may vary from several minutes to several hours. Preferably this time will range from about 0.5 hour to about 2 hours. Removal of reaction by-products, unconsumed reactants, and solvents may be accomplished by distillation, acid- or base-washing, or by solvent extraction procedures. Final product purification may be by distillation, crystallization, sublimation or the like.

When used as antioxidants, the products of this invention are effective when they constitute from about 0.005 to about 15% by weight of the lubricant base. Preferably, such concentration is from about 0.01 to about 10% by weight thereof, and more preferably from about 1.0 to about 5.0% by weight.

The lubricants which may be improved by the addition thereto of the above-mentioned carboxamide diarylamine are mineral oils, both paraffinic and naphthenic, synthetic oils, and greases made therefrom. The synthetic oils include polyolefin fluids, polyglycols, polyacetals, the siloxanes and the like. Especially useful are those synthetic esters which are becoming more and more popular, particularly in aviation. These include esters made from polycarboxylic acids and monohydric alcohols, such as those obtained by reacting methanol, ethanol, propanol, butanol, neopentyl alcohol and the like with pimelic acid, azelaic acid, adipic acid and the like, or from polyhydric alcohols and monocarboxylic acids. Of these preferred members are those made from trimethylol alkanes, where alkane includes ethane, propane and butane, pentaerythritol, di- and tripentaerythritol, or mixtures thereof and an aliphatic monocarboxylic acid containing from 1 to about 20 carbon atoms or a mixture of such acids. The most preferred are esters from the pentaerythritols and monocarboxylic acids having from about 5 to about 10 carbon atoms, or mixtures of these acids.

The following examples will serve to specifically illustrate the practice of the invention. It will be understood that they are illustrative only, and are not intended to limit the scope of the invention to a narrower range than described hereinabove.

EXAMPLE 1

N-1,1,3,3-Tetramethylbutyl-2-(1-naphthylamino)benzamide

To a solution of about 8 g. of N-phenyl-1-naphthylamine-2′-carboxylic acid chloride in 350 ml. of cyclohexane there was added while stirring 48 g. of t-octylamine (1,1,3,3-tetramethylbutylamine). The mixture was warmed on a steam bath for about one hour and allowed to cool. The reaction mixture was treated with dilute hydrochloric acid and the organic part was then washed with water, 20% aqueous potassium carbonate solution, water and was finally dried. N-1,1,3,3-tetramethylbutyl-2-(1-naphthylamine)benzamide was obtained as an oil after removal of volatile solvent by distillation.

Anal. Calc'd: N, 7.48. Found: N, 6.84.

EXAMPLE 2

N-n-Octyl-2-(1-naphthylamino)benzamide

As in the example above, to 8.5 g. of N-phenyl-1-naphthylamine-2′-carboxylic acid chloride in 300 ml. of cyclohexane was added 26.5 g. of octylamine. The reaction mixture was heated on a steam bath for 2 hours and worked up as above. The N-n-octyl-2-(1-naphthylamino)benzamide was obtained as an amber oil after solvent distillation.

Anal. Calc'd: N, 7.48. Found: N, 7.71.

EXAMPLE 3

N-1,1,3,3-Tetramethylbutyldiphenylamine-2-carboxamide

To a solution of 10.5 g. of 1,1,3,3-tetramethylbutylamine in 175 ml. of petroleum ether there was added while stirring 7.5 g. of diphenylamine-2-carboxylic acid chloride in 100 ml. of petroleum ether. The white solids which formed during the addition were removed by filtration and extracted with hot n-hexane. The extracts were combined with the first filtrate, washed with water, dried, and concentrated. The N-1,1,3,3-tetramethylbutyldiphenylamine-2-carboxamide was precipitated as a white solid, mp 124°–126°.

Anal. Calc'd for $C_{21}H_{28}ON_2$: C, 77.74; H, 8.70; N, 8.63. Found: C, 77.74; H, 8.74; N, 8.44.

EXAMPLE 4

N′-n-Octyldiphenylamine-2-carboxamide

As in the previous example, 7.5 g. of diphenylamine-2-carboxylic acid chloride in 100 ml. of petroleum ether was added while stirring to a solution of 10.5 g. of octylamine in 175 ml. of petroleum ether. After working up, the N′-n-octyldiphenylamine-2-carboxamide was obtained as a white crystalline solid, mp 36°–38°.

Calc'd for $C_{21}H_{28}ON_2$: C, 77.74; H, 8.70; N, 8.63. Found: C, 77.30; H, 8.79; N, 8.59.

EVALUATION OF PRODUCTS

Oxidation Test

The compounds produced in accordance with this invention were blended into a synthetic ester oil lubricant (made by reacting pentaerythritol with an equimolar mixture of $C_5$ and $C_9$ monocarboxylic acids) and tested in an oxidation test in accordance with the following procedure.

A sample of the test composition is heated and air at the rate of about 5 liters per hour is passed through for a period of about 24 hours. The products of Examples 1 to 4 are present in the test composition at concentrations of 1, 2 and 4% by weight. The test is carried out at 425°F. Present in the test sample are specimens of iron, copper, aluminum and lead. It should be noted that the metals are typical metals of engine or machine construction, and they also provide some catalysts for the oxidation of organic materials. One measure of the sample as an antioxidant is its ability to keep the change in kinematic viscosity, measured at 100°F. and expressed as ΔKV, at a minimum; another is its capability of preventing unacceptable increases in acid content (ΔNN). The results are tabulated in the following table.

TABLE 1

| Comp. | Conc., wt.% | Acidity,NN Final | ΔNN | Viscosity Final | ΔKV,% |
|---|---|---|---|---|---|
| — | — | — | 5.85 | — | 226 |
| Ex. 1 | 4 | 1.3 | 1.20 | 36.75 | 23 |
| | 2 | 1.6 | 1.55 | 32.41 | 9 |
| | 1 | 1.1 | 1.07 | 31.18 | 4 |
| Ex. 2 | 4 | 4.80 | 4.70 | 55.75 | 107 |
| | 2 | 4.80 | 4.75 | 45.79 | 70 |
| | 1 | 3.20 | 3.17 | 36.89 | 37 |
| Ex. 3 | 2 | 1.10 | 1.05 | 34.99 | 27 |
| | 1 | 0.80 | 0.77 | 32.33 | 17 |
| Ex. 4 | 2 | 1.10 | 1.05 | 31.23 | 15 |
| | 1 | 1.10 | 1.07 | 30.58 | 12 |

As a comparison, o—$CH_3NHC_6H_4CONHC_8H_{17}$ was tested in the above test at 1% concentration. The ΔNN was 4.44 and the ΔKV% was 90, which are higher than those of the compounds of this invention.

The above test was repeated, except that the temperature of the test was 450° F. and the concentration of each additive was 1 percent. As a comparison, $C_6H_5NHC_6H_4CONHC_6H_5$ was included in the test series. The results are tabulated in Table 2.

TABLE 2

| Additive | ΔNN | ΔKV% |
|---|---|---|
| None | 8.25 | 586 |
| Comparison | 3.84 | 106 |
| Ex. 1 | 1.25 | 31 |
| Ex. 2 | 2.04 | 100 |
| Ex. 3 | 1.26 | 25 |
| Ex. 4 | 2.92 | 83 |

As can be seen, this higher temperature test has a more adverse effect on the base oil than at 425°F. As with the previous comparison compound, the results for this second comparison compound are higher than those of the additives of the present invention.

Although the present invention has been described with certain specific embodiments, it is to be understood that modifications and variations may be resorted to without departing from the spirit and scope of this invention as those skilled in the art will readily understand. Such modifications and variations are considered to be within the purview and scope of the appended claims.

I claim:

1. A lubricant composition comprising a major amount of a lubricant selected from the group consisting of mineral oil, synthetic oil and greases thereof, and an amount sufficient to impart antioxidant properties thereto of:

N-1,1,3,3-tetramethylbutyl-2-(1-naphthylamino) benzamide.

2. The composition of claim 1 wherein said N-1,1,3,3-tetramethylbutyl-2-(1-naphthylamino) benzamide is present in said lubricant in an amount of from about 0.005 to about 15% by weight.

3. The composition of claim 1 wherein the lubricating oil is a synthetic ester oil.

4. The composition of claim 3 wherein the synthetic ester oil is one prepared from pentaerythritol and an aliphatic monocarboxylic acid containing from 1 to about 20 carbon atoms.

* * * * *